US011654699B2

(12) United States Patent
Viechter

(10) Patent No.: US 11,654,699 B2
(45) Date of Patent: May 23, 2023

(54) DRYER SYSTEM WITH EXHAUST GAS PURIFICATION

(71) Applicant: Canon Production Printing Holding B.V., Venlo (NL)

(72) Inventor: Manfred Viechter, Walpertskirchen (DE)

(73) Assignee: Canon Production Printing Holding B.V., Venlo (NL)

( * ) Notice: Subject to any disclaimer, the term of this patent is extended or adjusted under 35 U.S.C. 154(b) by 10 days.

(21) Appl. No.: 17/306,035

(22) Filed: May 3, 2021

(65) Prior Publication Data

US 2021/0347186 A1 Nov. 11, 2021

(30) Foreign Application Priority Data

May 5, 2020 (DE) ..... 102020112042.7

(51) Int. Cl.
*B41J 11/00* (2006.01)

(52) U.S. Cl.
CPC ..... *B41J 11/0022* (2021.01)

(58) Field of Classification Search
CPC ..... B41J 11/0022; B41J 11/002
See application file for complete search history.

(56) References Cited

U.S. PATENT DOCUMENTS 4,364,750 A * 12/1982 Koncz ..... B01D 47/06 95/200

FOREIGN PATENT DOCUMENTS

| | | | | |
|---|---|---|---|---|
| DE | 102010017239 A1 | 12/2011 | | |
| DE | 102011010071 A1 | 8/2012 | | |
| DE | 102015017058 A1 * | 8/2016 | ..... | G03G 13/20 |
| DE | 102015017058 A1 | 8/2016 | | |

OTHER PUBLICATIONS

German Search Report for German Application No. 10 2020 112042.7 dated Dec. 22, 2020.

* cited by examiner

*Primary Examiner* — Bradley W Thies
(74) *Attorney, Agent, or Firm* — The Webb Law Firm

(57) ABSTRACT

A dryer system is described that is configured to purify, by means of a wet scrubber, the exhaust gases created in the drying of a recording medium that has been printed to. Moreover, thermal energy may be extracted from the exhaust gases in the wet scrubber, which thermal energy is used in turn to dry the recording medium. An environmentally safe and energy-efficient drying may thus be enabled.

12 Claims, 3 Drawing Sheets

DRYER SYSTEM WITH EXHAUST GAS PURIFICATION

CROSS REFERENCE TO RELATED APPLICATIONS

This patent application claims priority to German Patent Application No. 10 2020 112 042.7, filed May 5, 2020, which is incorporated herein by reference in its entirety.

BACKGROUND

Field

The disclosure relates to a dryer system for drying a recording medium that has been printed to, in particular for use in an inkjet printing device.

Inkjet printing devices may be used to print to recording media, for example paper. For this purpose, one or more nozzles are used in order to fire ink droplets onto the recording medium, and thus to generate a desired print image on the recording medium.

An inkjet printing device may comprise one or more dryer systems in order to dry the recording medium after application of the print image, and to thereby fix the applied ink on the recording medium. A dryer system may have a drying route with a plurality of dryers. The individual dryers may be configured to blow a heated, gaseous drying medium, in particular air, onto the surface of the recording medium in order to dry said recording medium. The dryers may thereby be arranged along the drying route such that the recording medium does not come into contact with the dryers and floats through the dryer system.

Within the scope of the drying of a recording medium, the other substances, in particular solvents, in addition to water are extracted from the recording medium. It is thereby typically to be ensured that no flammable gases accumulate in the housing of the dryer systems, such that a dryer system for the most part has a relatively high air mass flow, which leads to a relatively high power consumption.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
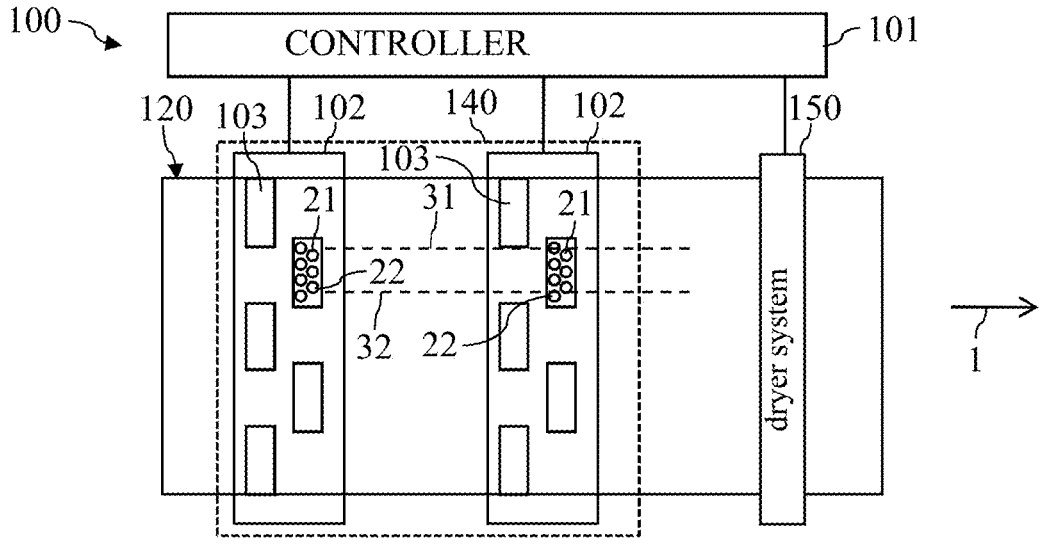

FIG. 1*a* a block diagram of an inkjet printer having a dryer or fixer according to an exemplary embodiment.

Figure 1B:
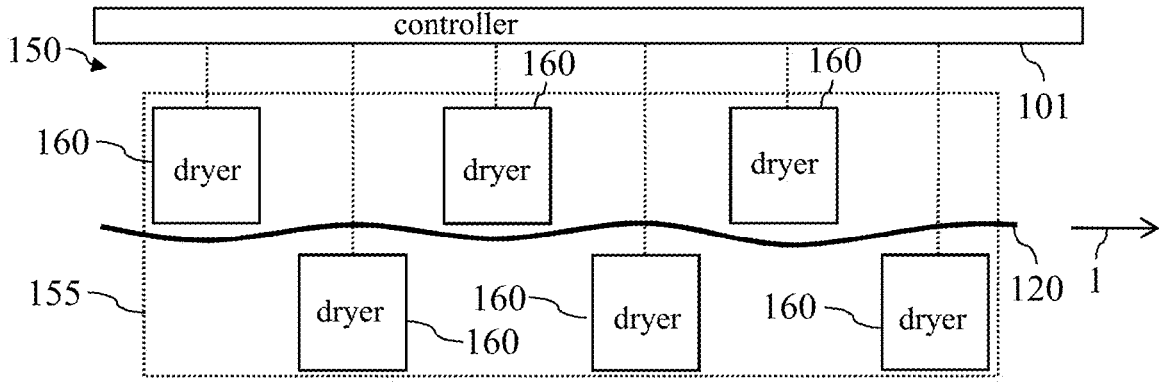

FIG. 1*b* a block diagram of a dryer system for an inkjet printer according to an exemplary embodiment.

Figure 1C:
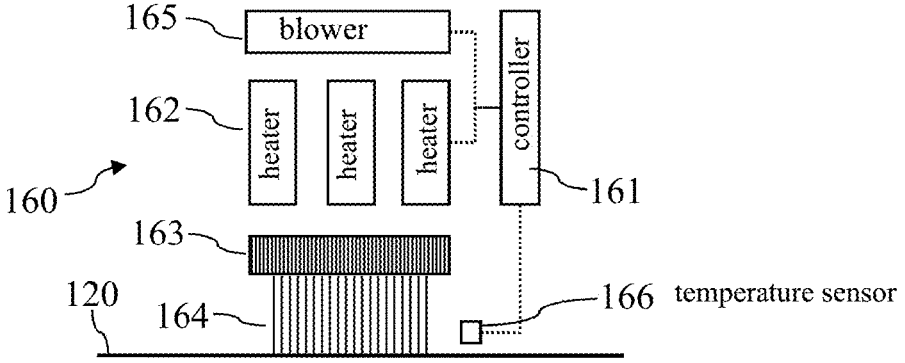

FIG. 1*c* a block diagram of a dryer for a dryer system according to an exemplary embodiment.

Figure 2A:
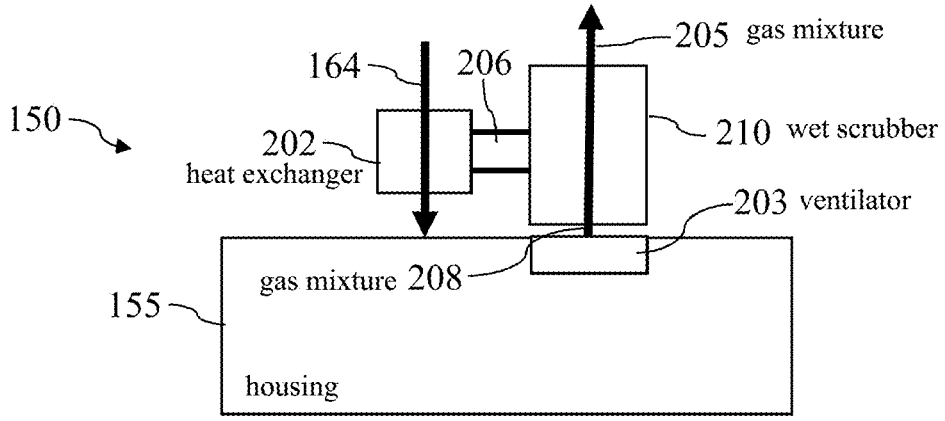

FIG. 2*a* an example of a dryer system having a wet scrubber according to an exemplary embodiment.

Figure 2B:
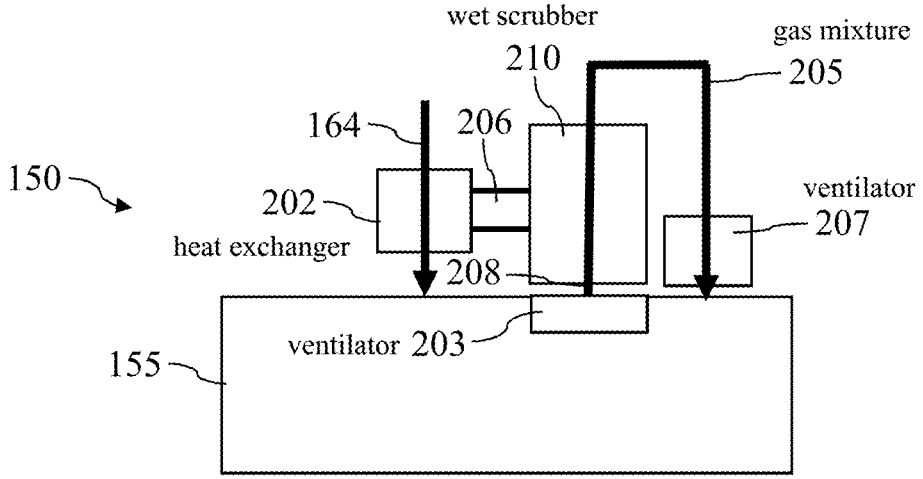

FIG. 2*b* an example of a dryer system having a wet scrubber and a recirculation of gaseous drying medium according to an exemplary embodiment.

Figure 3:
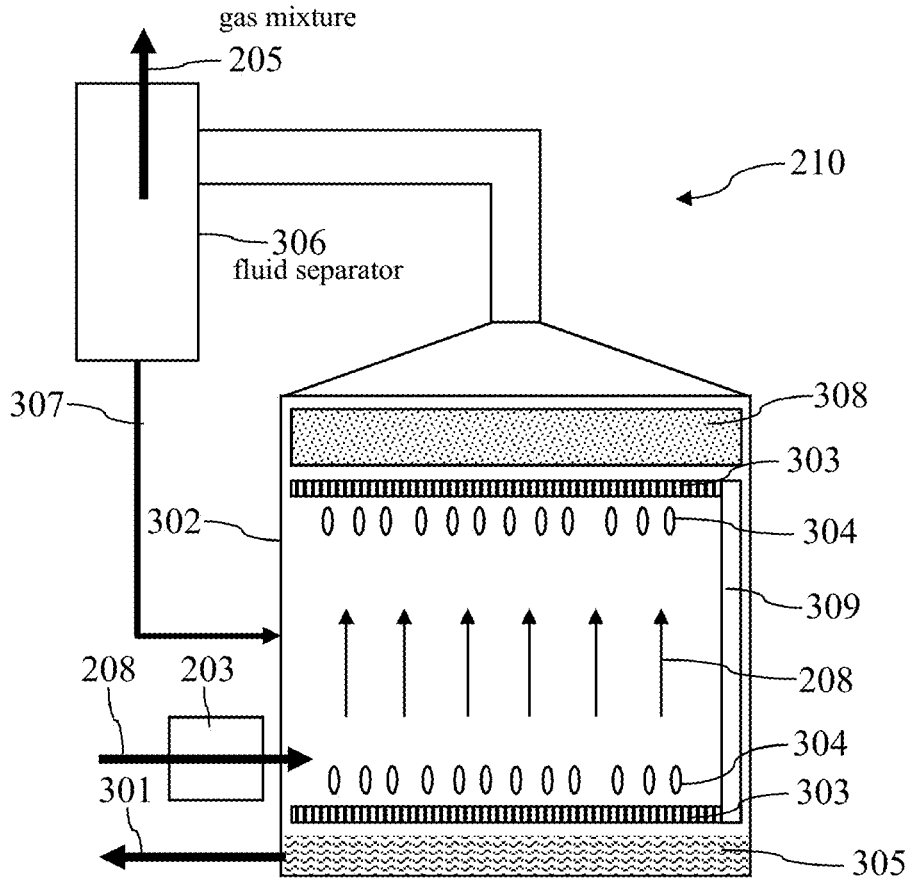

FIG. 3 a wet scrubber according to an exemplary embodiment.

Figure 4:
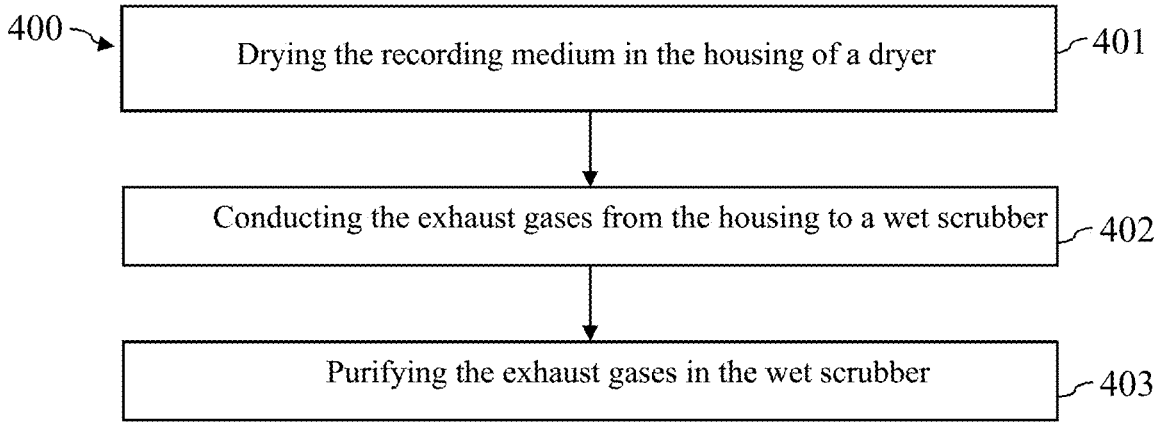

FIG. 4 a flowchart of a method for drying a recording medium according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

The present document deals with the technical object of providing an energy-efficient, safe, and environmentally friendly dryer system for a reliable drying of a recording medium.

According to one aspect of the disclosure, a dryer system is described for drying a recording medium that has been printed to. The dryer system comprises a housing having at least one dryer that is configured to apply thermal energy to the recording medium in order to extract moisture from said recording medium. The dryer system also comprises a ventilator that is configured to direct an exhaust gas with the moisture out of the housing, to a wet scrubber. Furthermore, the dryer system comprises the wet scrubber that is configured to purify the exhaust gas.

According to a further aspect of the disclosure, a method is described for drying a recording medium that has been printed to. The method includes the application of thermal energy to the recording medium in a housing of a dryer system in order to extract moisture from said recording medium. Furthermore, the method includes directing an exhaust gas with the moisture out of the housing, to a wet scrubber, and the purification of the exhaust gas using the wet scrubber.

The printing device (printer) 100 depicted in FIG. 1*a* is configured to print to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1, represented by an arrow, through the print group 140 of the printing device 100.

In the depicted example, the print group 140 of the printing device 100 comprises two print bars 102, wherein each print bar 102 may be used for printing with ink of a defined color, for example black, cyan, magenta, and/or yellow, and if applicable MICR ink. Furthermore, the printing device 100 comprises at least one fixing or dryer system 150 that is configured to fix a print image printed onto the recording medium 120.

A print bar 102 may comprise one or more print heads 103 that, if applicable, are arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of a group of columns 31, 32 of a print image onto the recording medium 120.

In the embodiment depicted in FIG. 1*a*, each print head 103 of the print group 140 comprises a plurality of nozzles 21, 22, wherein each nozzle 21, 22 is configured to fire or eject ink droplets onto the recording medium 120. A print head 103 of the print group 140 may, for example, comprise multiple thousands of effectively utilized nozzles 21, 22 that are arranged along a plurality of rows transverse to the transport direction 1 of the recording medium 120. By the nozzles 21, 22 of a print head 103 of the print group 140, dots of a line of a print image may be printed onto the recording medium 120 transverse to the transport direction 1, meaning along the width of the recording medium 120.

The printing device 100 also comprises a controller 101, for example an activation hardware and/or a controller, that is configured to activate the actuators of the individual nozzles 21, 22 of the individual print heads 103 of the print group 140 in order to apply the print image onto the recording medium 120 depending on print data. In an exemplary embodiment, the controller 101 includes processing circuitry that is configured to perform one or more functions and/or operations of the controller 101.

The print group 140 of the printing device 100 thus comprises at least one print bar 102 having K nozzles 21, 22 that may be activated with a defined line timing in order to print a line traveling transverse to the transport direction 1 of the recording medium 120 with K pixels or K columns 31, 32 of a print image onto the recording medium 120, for example with K>1000. In the depicted example, the nozzles 21, 22 are immobile or permanently installed in the printing device 100, and the recording medium 120 is directed past the stationary nozzles 21, 22 with a defined transport velocity.

As presented above, the printing device 100 may comprise a dryer system 150 that is configured to dry the recording medium 120 after application of the ink via the one or more print bars 102, and therewith to fix the applied print image on the recording medium 120. For this purpose, the dryer system 150 may be controlled by a controller 101 of the printing device 100. For example, the drying may take place depending on the quantity of applied ink and/or depending on a type of the recording medium 120. For example, the temperature and/or the volumetric flow of the gaseous drying medium may be adapted depending on the quantity of applied ink and/or depending on a type of the recording medium 120.

The dryer system 150 depicted in FIG. 1*b* comprises a plurality of dryers 160 that are arranged on both sides of the recording medium 120 (typically in the form of a belt) along a drying route, and that are respectively configured to blow a gaseous drying medium, typically heated air, onto the surface of the recording medium 120. The drying route with the dryers 160 is thereby arranged in a housing 155 of the dryer system 150. By blowing with a gaseous drying medium, the print image on a recording medium 120 may be gently and reliably dried along the drying route of the dryer system 150.

FIG. 1*c* shows a block diagram with examples of components of a dryer 160. The dryer 160 depicted in FIG. 1*c* comprises a blower 165 with which a gaseous medium, in particular air, may be directed past one or more heaters 162. Alternative or additional measures for generating a heated drying medium 164 are possible (for example the use of a gas burner). The drying medium 164 heated by the heaters 162 is then blown via one or more openings or nozzles 163 onto the surface of the recording medium 120. The one or more nozzles 163 may respectively be round-hole spinnerets, whereby a particularly good thermal transfer from the heated drying medium 164 to the recording medium 120 may be produced. The discharge rate of the blower 165 and/or the heating capacity of the one or more heaters 162 may be controlled or regulated via a controller 161 of the dryer 160, wherein the controller 161 may, if applicable, be part of the controller 101 of the dryer 160 or of the printing device 100. In an exemplary embodiment, the controller 161 includes processing circuitry that is configured to perform one or more functions and/or operations of the controller 161. In particular, the temperature in the environment of the recording medium 120 may be detected using a temperature sensor 166. The controller 161 may be configured to control or regulate the blower 165 and/or the one or more heaters depending on sensor data of the temperature sensor 166. For example, a defined temperature may thus be set in the environment of the recording medium 120.

A contactless float drying using forced convection may thus be used to dry a recording medium 120. As depicted in FIG. 1*b*, for this purpose the individual dryers 160 are arranged alternating on the front side and the back side of the recording medium 120 along the drying route. The recording medium 120 may then be pushed and/or pulled, floating past the dryers 160, through the dryer system 150.

During the drying, water vapor and solvent vapor escape from the recording medium 120. A gas mixture of water vapor and solvent vapor is thus created in the housing 155 of the dryer system 150. The gas mixture may be conveyed out of the housing 155 with a ventilator in order to avoid a flammable gas mixture forming inside said housing 155, and in order to remove the moisture from the housing 155 of the dryer system 150. In this document, the gas mixture is also referred to as exhaust gas.

FIGS. 2*a* and 2*b* respectively show a dryer system 150 having a wet scrubber 210 that is configured to purify the gas mixture extracted from the housing 155 of the dryer system 150. The gas mixture 208 may be extracted from the housing 155 of the dryer system 150 using a ventilator 203. The gas mixture 205 purified by the wet scrubber 210 may be discharged into the environment, as depicted in FIG. 2*a*, or be resupplied as a gaseous drying medium 164 to the one or more dryers 160, as depicted in FIG. 2*b*. For this purpose, a ventilator 207 may be used that directs the purified gas mixture 205 to the one or more dryers 160 in the housing 155 of the dryer system 150.

The dryer system 150 may comprise a heat exchanger 202 that is configured to heat the gaseous drying medium 164 before reaching the one or more dryers 160. In the wet scrubber 210, the thermal energy may thereby be extracted from the gas mixture 208 from the housing 155 of the dryer system 150 and be supplied to the gaseous drying medium 164 in the heat exchanger 202. For this purpose, one or more conduits 206 may be arranged between the wet scrubber 210 and the heat exchanger 202. The energy efficiency of the dryer system 150 may be increased via the use of a heat exchanger 202.

FIG. 3 shows an example of a wet scrubber 210. The wet scrubber 210 may comprise a washing chamber in which is formed a curtain of droplets 304 of a cleaning fluid. The curtain of cleaning fluid droplets 304 may be generated by one or more porous conduits 303, for example, that are arranged on the top side and/or on the underside of the washing chamber 302, for example, and through which the cleaning fluid is pumped from a supply conduit 309 into the washing chamber 302.

The gas mixture 208 to be purified is directed through the washing chamber 302, wherein solvent from the gas mixture 208 is captured by the cleaning fluid droplets 304 and thus is removed from the gas mixture 208. The washing chamber 302 has on the floor a capture basin 305 in which the cleaning fluid 301 with the solvent (for example ethylene glycol) is collected. The captured cleaning fluid 301 is thereby warmed by the heated gas mixture 208 and may be directed via the conduit 206 to the heat exchanger 202 in order to transfer thermal energy from the gas mixture 208 to the gaseous drying medium 164.

The gas mixture 208 may be filtered via a filter 308, if applicable on the top side of the washing chamber 302, in order to further purify the gas mixture 208. The gas mixture 208 may also be directed to a fluid separator 306 that, for example, operates according to the cyclone principle in order to remove fluid 307, in particular water, from the gas mixture 208. The purified gas mixture 205 may then be provided at the output of the fluid separator 306. The fluid 307 extracted from the gas mixture 208 may be used as cleaning fluid in the wet scrubber 210.

A dryer system 150 is thus described having a wet scrubber 210 for exhaust air treatment. The reduction of the solvent content in the exhaust air, i.e. in the gas mixture 208 to be purified or in the exhaust gases 208, may thereby be produced via the use of a wet scrubber 210.

Furthermore, a reduction in the concentration of solvent in the dryer housing 155 may be produced in order to ensure a safer operation of the dryer system 150 and in order to continuously maintain a high drying effect.

Thermal energy may be extracted from the exhaust air 208 via use of a heat exchanger, in particular of an air-water heat exchanger. The wet scrubber 210 may thereby be used as a heat exchanger. A media separation between the exhaust air 208 and the cleaning fluid 301 to be captured is thereby typically unnecessary, since water vapor is already contained in the exhaust air 208, and a certain content of solvent, which has a higher boiling point than water, typically does not interfere with the cooling and condensation process in the washing chamber 302. The effectiveness of the heat transfer, and therefore the condensation performance, improves due to omitting the separating wall of the heat exchanger.

In the purification of exhaust air, the washing solution at the fluid distributor should have an optimally low temperature. The productive capacity of the exhaust gas purification may be adjusted via the droplet size of the droplets 304 and via the residence time of the exhaust air 208 in the washing chamber 302 or washing column. The substance having the higher boiling point, i.e. the solvent, for instance ethylene glycol having a boiling point of 197° C., preferentially condenses on the droplets 304. The smaller the droplets 304, the larger the surface area available for condensation. Given a droplet size of 110 μm, for example, 1 liter of water has a surface area of 5.45 $m^2$; given a droplet size of 12 μm, 1 liter of water already has a surface area of 50.2 $m^2$. The purification effect may thus be increased via the use of relatively small droplets 304.

The possible entrainment of washing solution, i.e. cleaning fluid, in the exhaust air flow may be prevented by a cyclone separator and/or a different droplet separator 306, for example. The cooling of the washing solution may take place via a water/water heat exchanger or via a water/air heat exchanger. In the latter instance, the exhaust air 205 of the heat exchanger may be used as a supply air of the dryer system 150, so that the total energy demand of the dryer system 150 may be further reduced.

As depicted in FIG. 2*b*, a wet scrubber 210 may be directly integrated into the air circuit of the dryer system 150. In this instance as well, heat recovery is possible in the cooling of the washing solution and may lead to a reduction of the total energy demand of the dryer system 150.

Furthermore, a combination of the arrangements shown in FIGS. 2*a* and 2*b* into a common wet scrubber 210 is possible.

FIG. 4 shows a waveform diagram of an example of a method 400 for drying a recording medium 120 that has been printed to. The method 400 includes the introduction or application 401 of thermal energy to the recording medium 120 in the housing 155 of a dryer system 150 in order to extract moisture from said recording medium 120, and in order to thereby dry the recording medium 120 or the print image on the recording medium 120. The thermal energy may, for example, be applied via application of a heated, gaseous drying medium 164 at the recording medium 120.

Within the scope of the drying, exhaust gases 208 are typically created that, for example as water vapor, comprise the moisture that was extracted from the recording medium 120. Moreover, the exhaust gases 208 may comprise contaminants, in particular solvent vapor. The method 400 also comprises the conducting 402 of the exhaust gas 208 with the moisture from the housing 155 to a wet scrubber 210. Moreover, the method 400 comprises the purification 403 of the exhaust gas 208 in the wet scrubber 210.

Within the scope of the purification of the typically warm exhaust gases 208, thermal energy may be extracted from said exhaust gases 208. In particular, thermal energy may be transferred from the exhaust gases 208 to the cleaning fluid 301 of the wet scrubber 210. The thermal energy may then in turn be used to dry the recording medium 120 or to dry a subsequently recording medium 120. An environmentally friendly and energy-efficient drying of a recording medium 120 may thus be produced.

A dryer system 150 for drying a recording medium 120 that has been printed to is thus described. The dryer system 150 may be part of an inkjet printing device 100.

The dryer system 150 comprises a housing 155 having at least one dryer 160 that is configured to introduce or apply thermal energy to the recording medium 120 in order to extract moisture from the recording medium 120. A great deal of moisture may thereby be extracted from the recording medium 120, and in particular the print image on the recording medium 120, such that said recording medium 120 is dried at the output of the housing 155 of the dryer system 150.

The dryer system 150 may comprise a plurality of dryers 160 within the housing 155 that are arranged on different sides of the recording medium 120 such that a drying route is formed by the dryers 160, along which drying route the recording medium 120 is directed without contact past the dryers 160. The individual dryers 160 may thereby be configured to respectively blow a heated, gaseous drying medium 164 onto the recording medium 120 in order to extract moisture from said recording medium 120. The dryer system 150 may thus be configured for a float drying of the recording medium 120. A particularly gentle drying of the recording medium 120 may thus be produced.

The dryer system 150 also comprises a ventilator 203 that is configured to direct an exhaust gas 208 with the moisture extracted from the recording medium 120 out of the housing 155, to a wet scrubber 210. Due to the drying of the recording medium 120, exhaust gases 208 may form inside the housing 155 of the dryer system 150, which exhaust gases 208 may be guided by the ventilator 203 out of the housing 155, to a wet scrubber 210. In addition to the moisture, meaning in addition to water vapor, the exhaust gases 208 thereby typically also comprise contaminants, in particular solvents.

The wet scrubber 210 of the dryer system 150 is configured to purify the exhaust gas or exhaust gases 208 from the housing 155 of the dryer system 150. The purified exhaust gases 205 may then be directed into the environment, or may possibly be directed at least in part back into the housing 155 of the dryer system 150. A particularly environmentally safe drying of a recording medium 120 may be produced via the provision of wet scrubber 210.

The wet scrubber 210 may be configured to extract thermal energy from the exhaust gas 208 from the housing 155 of the dryer system 150 and supply it to the dryer 160. For this purpose, the wet scrubber 210 may be configured as a heat exchanger, in particular as a gas-fluid heat exchanger, between the exhaust gases 208 and the cleaning fluid 301 of the wet scrubber 210. Furthermore, the dryer system 150 may comprise a heat exchanger 202, in particular a fluid-gas heat exchanger, which is configured to heat the gaseous drying medium 164 using thermal energy that has been extracted from the exhaust gas 208 by the wet scrubber 210.

The wet scrubber 210 may thus be used to recuperate thermal energy from the exhaust gases 208, and to dry the recording medium 120 or a subsequent recording medium 120. A particularly energy-efficient drying may thus be enabled.

A dryer system 150 is thus described that is configured to purify, using a wet scrubber 210, exhaust gases 208 created in the drying of a recording medium 120 that has been printed to. Moreover, thermal energy may be extracted from the exhaust gases 208 in the wet scrubber 210, which thermal energy is used in turn to dry the recording medium 120. An environmentally safe and energy-efficient drying may thus be enabled.

The wet scrubber 210 may comprise a washing chamber 302. Furthermore, the wet scrubber 210 may be configured to form a plurality of droplets 304 from cleaning fluid in the washing chamber 302. The wet scrubber 210 may also be configured to direct the exhaust gas 208 from the housing 155 of the dry 150 through the washing chamber 302, past the plurality of droplets 304 of cleaning fluid, in order to have the effect that contaminants, in particular solvents, are removed from the exhaust gas 208 via droplets 304 of cleaning fluid, in particular in order to have the effect that contaminants, in particular solvents, condense out of the exhaust gas 208 onto droplets 304 of cleaning fluid. A reliable purification of the exhaust gases 208 may thus be produced.

Moreover, the wet scrubber 210 may be configured such that, in the washing chamber 302, thermal energy transfers from the exhaust gas 208 to the cleaning fluid 301. This may be produced in particular via the condensation of the contaminant on the droplets 304 of cleaning fluid. The heat exchanger 202 of the dryer system 150 may then be configured to extract thermal energy from the cleaning fluid 301 heated by the exhaust gas 208, which cleaning fluid 301 typically also contains the contaminants from the exhaust gases 208, and to supply said thermal energy to the at least one dryer 160, in particular to the gaseous tempering medium 164. A particularly energy-efficient operation of the dryer system 150 may thus be enabled.

The dryer system 150 may be configured to supply exhaust gases 205 purified by the wet scrubber 210 from the housing 155 of the dryer system 150 to the at least one dryer 160 as a heated, gaseous drying medium 164 to dry the recording medium 120. The energy efficiency of the drying may be further increased via the recirculation of the purified exhaust gases 205.

The wet scrubber 210 may a comprise filter 308 that is configured to filter the exhaust gases 208 from the housing 155 of the dryer system 150 after traversing the washing chamber 302 of the wet scrubber 210. The filter 308 may comprise a lamella separator and/or a wire mesh separator. Alternatively or additionally, the wet scrubber 210 may comprise a fluid separator 306 that is configured to remove fluid from the exhaust gases 208 after the exhaust gases 208 have traversed the washing chamber 302 of the wet scrubber 210. A particularly reliable purification of the exhaust gases 208 may thus be produced.

In this document, an inkjet printing device 100 is also described that comprises a print group 140 that is configured to print a print image on a recording medium 120. The printing device 100 comprises the dryer system 150 described in this document, which dryer system 150 is configured to dry the print image on the recording medium 120.

The effectiveness in the removal of flammable and/or ecologically harmful solvents from the drying process may be increased via the use of a wet scrubber 210. In particular, the effectiveness of the condensation of solvents may be significantly increased via the use of a relatively large interface between gas and fluid in a wet scrubber 210, in particular in comparison to the use of heat exchangers with a separation between air and water. The thermal energy transferred via the condensation heat to the cleaning fluid 301 may be used by an air-water heat exchanger 202 for preheating the gaseous drying medium 164.

The necessary air throughput of a dryer system 150 may be reduced via an improved condensation of the flammable solvent from the gas mixture 208 to be purified. This leads to a reduced energy requirement, since a reduced quantity of air (i.e. of drying medium 164) needs to be heated to process temperature. Additionally, the heat exchanger surface in a wet scrubber 210 cannot be contaminated, since this surface is continuously reformed via the droplet formation.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein. In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle (print image)
31, 32 column (of the print image)
100 printing device (printer)
101 controller
102 print bar
103 print head
120 recording medium
140 print group
150 fixer or dryer system
160 dryer
161 controller
162 heating element (heater)
163 nozzle
164 tempered drying medium (air)
165 blower
166 temperature sensor
202 heat exchanger
203 blower
205 purified exhaust gases
206 conduit
207 ventilator
208 exhaust gases to be purified
210 wet scrubber
301 heated and contaminated cleaning fluid
302 washing chamber
303 porous conduit
304 droplets of cleaning fluid
305 capture basin
306 fluid separator
307 separated fluid
308 filter
309 supply line for cleaning fluid
400 method for drying a recording medium
401-403 method steps

The invention claimed is:

1. A dryer system for drying a recording medium that has been printed to, the dryer system comprising:

a housing having at least one dryer that is configured to apply thermal energy to the recording medium to extract moisture from the recording medium;

wherein the dryer is configured to blow a heated, gaseous drying medium onto the recording medium to extract moisture from the recording medium;

a ventilator that is configured to conduct an exhaust gas, with the moisture, out of the housing and to a wet scrubber; and the wet scrubber configured to purify the conducted exhaust gas;

wherein the wet scrubber is configured to extract thermal energy from the exhaust gas from the housing of the dryer system and supply the thermal energy to the dryer; and a heat exchanger that is configured to heat the gaseous drying medium using thermal energy that has been extracted from the exhaust gas by the wet scrubber.

2. The dryer system according to claim 1, wherein:

the wet scrubber comprises a washing chamber;

the wet scrubber is configured to form a plurality of droplets of cleaning fluid in the washing chamber; and the wet scrubber is configured to direct the exhaust gas from the housing of the dryer system through the washing chamber, past the plurality of droplets of cleaning fluid, to remove contaminants from the exhaust gas by droplets of cleaning fluid.

3. The dryer system according to claim 2, wherein the wet scrubber is configured to direct the exhaust gas past the plurality of droplets of cleaning fluid such that the contaminants are condensed on the droplets of cleaning fluid.

4. The dryer system according to claim 2, wherein:

the wet scrubber is configured such that thermal energy transfers from the exhaust gas to the cleaning fluid in the washing chamber; and the heat exchanger is further configured to extract thermal energy from the cleaning fluid heated by the exhaust gas and supply the thermal energy to the dryer.

5. The dryer system according to claim 1, wherein the dryer system is configured to supply exhaust gases purified by the wet scrubber from the housing of the dryer system to the dryer as a heated, gaseous drying medium to dry the recording medium.

6. The dryer system according to claim 1, wherein the wet scrubber comprises:

a filter that is configured to filter the exhaust gases from the housing of the dryer system after passing through a washing chamber of the wet scrubber; or a fluid separator that is configured to remove fluid from the exhaust gases after the exhaust gases have traversed the washing chamber of the wet scrubber.

7. The dryer system according to claim 1, wherein the wet scrubber comprises:

a filter that is configured to filter the exhaust gases from the housing of the dryer system after passing through a washing chamber of the wet scrubber; and a fluid separator that is configured to remove fluid from the exhaust gases after the exhaust gases have traversed the washing chamber of the wet scrubber.

8. The dryer system according to claim 1, wherein the dryer system comprises a plurality of dryers that are arranged on different sides of the recording medium such that a drying route is formed by the plurality of dryers, the recording medium being directable along the drying route, without contact, past the plurality of dryers.

9. An inkjet printer, comprising:

a print group that is configured to print a print image on a recording medium; and a dryer system configured to dry the print image on the recording medium, the dryer system including:

a housing having at least one dryer that is configured to apply thermal energy to the recording medium to extract moisture from the recording medium;

wherein the dryer is configured to blow a heated, gaseous drying medium onto the recording medium to extract moisture from the recording medium;

a ventilator that is configured to conduct an exhaust gas, with the moisture, out of the housing and to a wet scrubber; and the wet scrubber configured to purify the conducted exhaust gas;

wherein the wet scrubber is configured to extract thermal energy from the exhaust gas from the housing of the dryer system and supply the thermal energy to the dryer; and a heat exchanger that is configured to heat the gaseous drying medium using thermal energy that has been extracted from the exhaust gas by the wet scrubber.

10. The inkjet printer according to claim 9, wherein the at least one dryer is a blower.

11. A method for drying a recording medium that has been printed to, the method comprising:

applying thermal energy to the recording medium in a housing of a dryer system to extract moisture from the recording medium by blowing a heated, gaseous drying medium onto the recording medium to extract moisture from the recording medium;

conducting an exhaust gas with the moisture out of the housing and to a wet scrubber;

extracting thermal energy from the exhaust gas from the housing of the dryer system and supplying the thermal energy to the dryer by the wet scrubber;

heating, with a heat exchanger, the gaseous drying medium using thermal energy that has been extracted from the exhaust gas by the wet scrubber; and purifying the exhaust gas in the wet scrubber.

12. A non-transitory computer-readable storage medium with an executable program stored thereon, that when executed, instructs a processor to perform the method of claim 11.

* * * * *